US005294327A

United States Patent [19]

Everett

[11] Patent Number: 5,294,327

[45] Date of Patent: Mar. 15, 1994

[54] METHOD OF PRODUCING FOOD GRADE QUALITY WHITE MINERAL OIL

[75] Inventor: Gary L. Everett, Kingswood, Tex.

[73] Assignee: Atlantic Richfield Company, Plano, Tex.

[21] Appl. No.: 945,029

[22] Filed: Sep. 15, 1992

Related U.S. Application Data

[63] Continuation of Ser. No. 730,667, Jul. 16, 1991, abandoned, which is a continuation-in-part of Ser. No. 491,511, Mar. 12, 1990, abandoned.

[51] Int. Cl.[5] ..... C10G 45/00

[52] U.S. Cl. ..... 208/57; 208/58; 208/97; 208/210

[58] Field of Search ..... 426/417, 531; 208/57, 208/58, 97, 210

[56] References Cited

U.S. PATENT DOCUMENTS 4,251,347 2/1981 Rausch et al. ..... 208/57
4,263,127 4/1981 Rausch et al. ..... 208/58
4,325,804 4/1982 Everett et al. ..... 208/58
4,810,355 3/1989 Hopkins ..... 208/58

*Primary Examiner*—Donald E. Czaja
*Assistant Examiner*—Leslie Wong
*Attorney, Agent, or Firm*—Geoffrey A. Mantooth

[57] ABSTRACT

The production of food grade quality white mineral oils from predominantly naphthenic or cycloparaffinic crude distillates heretofore have required acid treating using sulfuric acid followed by neutralization, water wash and possibly finishing step. Herein, however, three stages of hydroprocessing without any solvent extraction or acid treatment prior step are employed to produce the desired food grade quality white mineral oil having a trace of aromatic constituents therewithin. Specific steps are defined in the application in terms of the severity of the hydrogenation in the hydrotreatiang operation at each respective step; as well as the steps of separating gaseous constituents of the hydroprocessing product.

6 Claims, 1 Drawing Sheet

METHOD OF PRODUCING FOOD GRADE QUALITY WHITE MINERAL OIL

CROSS REFERENCE TO RELATED APPLICATIONS

This is a continuation of application Ser. No. 07/730,667, filed Jul. 6, 1991, now abandoned, which is a continuation-in-part of application Ser. No. 07/491,511, filed Mar. 12, 1990, now abandoned.

FIELD OF THE INVENTION

This invention relates to the method of producing food grade quality white mineral oil. More particularly, this invention relates to a method of producing from a naphthenic distillate as a feed stock, a food grade white mineral oil with only a trace of aromatics therewithin.

BACKGROUND OF THE INVENTION

The prior art is replete with various referrals to methods of treating hydrocarbons. These range from the technology during the depression to modern methods of treating hydrocarbons.

There are almost as many references to employing hydrogen in hydrogenation and hydrotreating aspects. Included are a couple of textbooks published right after World War II including "The Textbook of Organic Chemistry" by E. Wertheim, Second Edition, Blakiston Company, Philadelphia Pennsylvania, 1947, and "Uniprocesses in Organic Synthesis", Groggins, Editor, 3rd Edition, McGraw Hill, New York, New York, 1947. As pointed out in these texts, careful control of hydrogenation can give careful results. This application envisions employing such careful control.

The prior art has seen many ways of trying to achieve a food grade quality of white mineral oil but they have always been expensive and employed acid treatment, neutralization and an adsorption tower or the like for removing of undesired constituents to give the final product.

Specifically, the prior art has failed to provide an economical method of achieving a food grade quality white mineral oil without expensive and labor intensive steps such as acid treating, neutralization and absorbing of undesired constituents from the product.

SUMMARY OF THE INVENTION

Accordingly it is an object of this invention to provide an economical method of achieving a food grade white mineral oil without the labor intensity of processes of the prior art.

It is a specific object of this invention to provide an economical continuous flow process of providing a food grade white mineral oil without the labor intensive processes of the prior art. These and other objects will become apparent when taken with the descriptive matter hereinafter, particularly when taken in conjunction with the appended drawings.

In accordance with one aspect of this invention, there is provided a method of producing a food grade quality of white mineral oil by subjecting a naphthenic or cycloparaffinic feed stock to three st-ages of hydroprocessing without any solvent extraction or acid treatment prior to the treatment to give the final desired quality with only a trace of the aromatic hydrocarbons, or aromatic carbons therewithin.

In another aspect of this invention, there is provided a method of producing a food grade quality in which a naphthenic feed stock is first hydrogenated followed by a step of separating gaseous constituents produced during the hydrogenation reactions, followed by a second stage of hydroprocessing, or hydrogenation, followed by separation of the gaseous constituents produced by this second stage of hydrogenation, followed by a third and less severe hydrotreating step to produce the desired food grade white mineral oil.

Specific reaction conditions for the respective steps are discussed hereinafter.

DESCRIPTION OF PREFERRED EMBODIMENT

Figure 1:
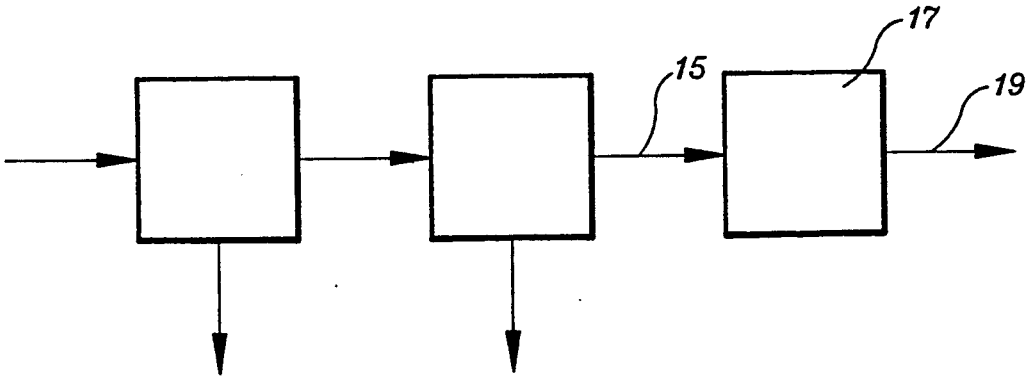
FIG. 1 is a schematic flow diagram of a prior art process for producing food grade white mineral oil.

FIG. 1 illustrates a prior art method of preparing a food grade white mineral oil. Therein, a naphthenic distillate is extracted with a solvent such as a phenol or N-methyl pyrrillodone to produce a hydrocarbon oil containing only about 4 to 7 percent aromatic carbons which are subjected to an acid treatment. The bottoms fraction recovered from the acid treatment then emerges as acid sludge whereas from the first step of solvent extraction, a solvent extract containing a high level of aromatic compounds is recovered as a bottom product. After the acid treatment, only a trace of aromatic carbons, or aromatic hydrocarbons are in line 15 leading from the acid treater. A finishing step consisting of an absorption tower 17 employing clay or a hydrotreater tower 17 using hydrogen is employed to lower the remaining trace quantity of aromatics and produces a satisfactory food grade white mineral oil in the effluent line 19.

Figure 2:
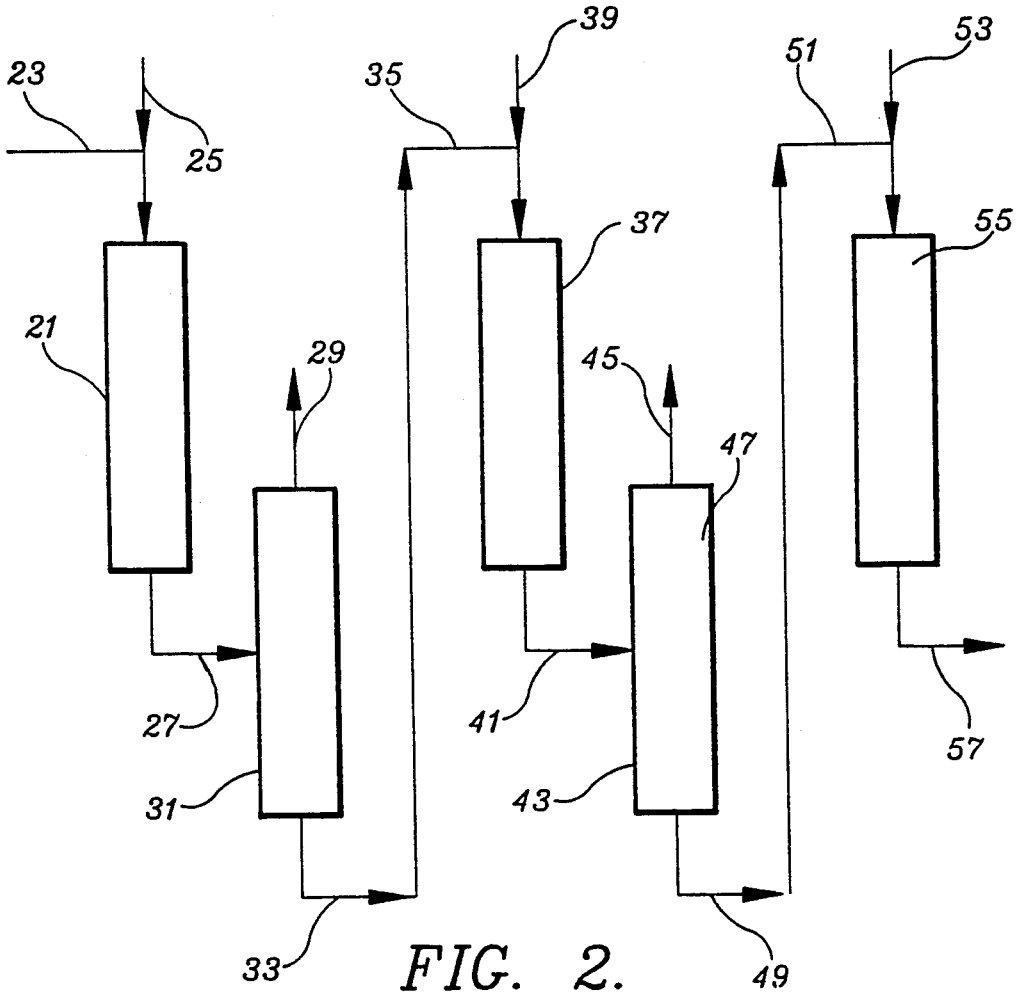
FIG. 2 is a schematic flow diagram of the process of this invention for producing food grade white mineral oil.

In contrast, the approach of this invention involves subjecting a naphthenic distillate containing a concentration of aromatic carbons in the range of 15–25 percent by weight to hydrogenation to produce a hydrogenated product in which there is a reduction of about 50 to 70 percent of the aromatic hydrocarbons to yield an aromatic carbon content of 7–10 percent by weight. This hydrogenation step employs only about 1800 PSIG partial pressure of hydrogen and differs from the one practiced in U.S. Pat. No. 4,263,127, since essentially no ring cracking takes place and Viscosity Index (VI) herein increases less than 20 units, whereas with hydrocracking as practiced by Rausch et al (U.S. Pat. No. 4,263,127) has at least 20 units VI increase and preferably 30 over feed values. This is shown in FIG. 2, at stage 1, also labeled tower 21. The term "naphthenic distillates" is synonymous with cycloparaffinic distillates. Normally these distillates contain about 15–25 percent by weight of aromatic carbons. These naphthenic distillates come in via line 23, FIG. 1. Hydrogen is fed through line 25 in FIG. 2. Both feed constituents are admixed prior to entering stage 1 where hydrogenation is carried out in the presence of a hydrogenation.. catalyst containing metal components from the Group VIB class, preferably Molybdenum. To prevent unwanted hydrocracking reactions, no acid functional catalyst components: like, silica, aluminum or borea are included. The temperature is 550 degrees Fahrenheit to 750 degrees Fahrenheit, preferably about 650 degrees Fahrenheit–700 degrees Fahrenheit with a partial pressure of hydrogen of only 1800 pounds per square inch gauge (PSIG), preferably about 1500–1800 pounds per square inch gauge. The hydrogenated product then exits the tower 21 through the line 27.

As the next step, the gaseous constituents of the hydrogenated product in line 27 are separated from liquid constituents and flow out through the overhead line 29. The overhead line 29 carries from the stripper 31 hydrogen sulfide and ammonia, inter alia, as the gaseous products of the hydrogenation reactions carried out in the hydrogenation tower of stage 1, labelled 21. After this process, the aromatic carbon content of the liquid constituents will have been reduced to about 7–10 percent aromatic carbons as in the liquid bottom draw from the stripper, line 33. These liquid bottoms containing only about half as much aromatic carbons as the initial feed stock in line 23, or less are then sent through line 35 to a second hydrogenation tower 37. The liquid bottoms, or hydrogenated product from the first stage, in line 35 is admixed with hydrogen by way of line 39. A second hydrogenation is carried out at rather severe conditions in the presence of a hydrogenation catalyst containing metal components from the Group VIIIB class, preferably Nickel and from the Group VIB class, preferably Molybdenum, with the hydrogen partial pressure in the range of 2500–3000 PSIG, preferably 2750–3OOO PSIG and a temperature in the range of 575–750 degrees Fahrenheit, preferably 625–700 degrees Fahrenheit. The entire reactor effluent then exits by a line 41 to stripper 43 and again the gaseous constituents of the second hydrogenation stage reaction product are separated from liquid constitutes and exit line 45 from the second stripper 47. These gaseous constituents include hydrogen sulfide and ammonia, inter alia. The resulting liquid bottoms from the stripper 43, in line 49, contain only about 1 percent of aromatic carbons and they are sent, as by line 51 to be admixed with hydrogen in line 53 and the hydrogenation as a final step carried out is carried out in stage 3, or the final, less severe hydrogenation of stage 3 in the hydrogenation tower 55.

In the final step, less severe hydrogenation of stage three in the third hydrogenation tower, or hydrotreating tower 55, is carried out in the presence of a hydrogenation catalyst containing a metal component of Group VIIIB class such as platinum, palladium or Nickel, preferably platinum in the form usually utilized in reforming reactions with hydrogen partial pressue in the range of 2000–3000 PSIG, preferably 2500–3000 PSIG and temperature of only about 375 degrees Farenheit to 600 degrees Fahrenheit, preferably 450 degrees Fahrenheit–550 degrees Fahrenheit.

It is noteworthy that in all these reactions, the use of a relatively high partial pressure hydrogen and relatively lower temperature facilitates carrying out the hydrogenation to give the desired reaction product in reducing the aromatic constituents of the liquid stream without excessive hydrocracking of the stream to undesired lower boiling range material.

In the illustrated embodiment, the liquid bottoms draw in the line 57 will have only about 0.3 percent or less by weight of aromatic constituents and this trace of aromatics is satisfactory as a food grade white mineral oil. Specifically, the polynuculear aromatics will comprise less than 30 parts per million (PPM) of the final food grade white mineral oil.

In operation, the naphthenic distillate comprising initial feed stock is fed into and admixed with the hydrogen at the desired partial pressure in the incoming stream and hydrogenation is carried out in stage 1. Similarly, in a stripper, the gaseous constituents are allowed to separate from the liquid constituents such that the gases pass out the overhead stream in line 29 and the bottoms pass out the liquid stream 33 and are then fed through the line 35, FIG. 2, to the second stage, or hydrotreating tower, 37. Again, the admixture of hydrogen at its high partial pressure with the liquid constituents effects a direct reaction at elevated temperatures over suitable catalyst to produce the reduction in the aromatic carbons in line 41 such that after the gaseous constituents are separated and go to the overhead line 45, the liquid bottom draw 49 can be fed, low as it is in aromatic carbons, to the third hydrogenation stage 55. At the entrance to the third stage, it is admixed with high pressure hydrogen at the desired high partial pressure and the hydrogenation reactions carried out in the third hydrotreating tower 55. The result is that the final product comes out the bottom effluent line 57.

From the foregoing it can be seen that the desired food grade quality white mineral oil is produced in the line 57 by a process that differs substantially from the prior art technology for preparing food grade white mineral oil.

Although this invention has been described with a certain degree of particularity, it is understood that the present disclosure is made only by way of example and that combination and arrangement of parts may be resorted to without departing from the spirit and the scope of the invention, reference being had for the latter purpose to the appended claims.

What is claimed is:

1. A method of producing a food grade quality white mineral oil comprising the steps of:

a. subjecting a naphthenic, or cycloparaffinic, distillate containing a concentration of aromatic carbons in the range of 15–25 percent by weight to hydrogenation under relatively mild conditions of 1500–1800 psig partial pressure of hydrogen and 550–750 degrees Fahrenheit, by contacting the distillate with hydrogen in the presence of a hydrogenation catalyst, said hydrogenation catalyst comprising metal components from the group VIB class and being free of aluminum, silica or borea to prevent unwanted hydrocracking reactions, to produce a hydrogenated product in which the Viscosity Index (VI) increase is no greater than about 20 and in which the aromatic carbon concentration is reduced by about fifty percent;

b. separating the gaseous constituents of the hydrogenated product to prepare a liquid bottoms draw;

c. subjecting said liquid bottoms draw after said gaseous constituents have been separated therefrom to a second step of hydrogenation under severe hydrogenation conditions of 2500–3000 psig and about 575–750 degrees Fahrenheit to produce a second hydrogenated product;

d. separating the gaseous constituents of said second hydrogenated product to produce a second liquid bottoms stream; and e. finally subjecting said second liquid bottoms stream to a final, less severe hydrotreating step to produce a food grade quality white mineral oil having a reduced amount of aromatics therewithin.

2. The method of claim 1 wherein step a. of claim 1 is carried out with a temperature in a range of 650–750 degrees Fahrenheit.

3. A method of producing a food grade white mineral oil from a naphthenic distillate, comprising the steps of:

a. contacting the naphthenic distillate with hydrogen in the presence of a first hydrogenation catalyst, said first hydrogenation catalyst comprising metal components from the group VIB class and being free of aluminum, silica or borea to prevent unwanted hydrocracking reactions, to form a first hydrogenated product, which first hydrogenated product has a viscosity index increase of less than 20;

b. contacting the first hydrogenated product from step a. with hydrogen, under hydrogenation conditions, in the presence of a second hydrogenation catalyst to form a second hydrogenated product, said second hydrogenation catalyst comprising metal components from the group VIIIB class and the group VIB class;

c. contacting the second hydrogenated product from step b. with hydrogen, under hydrogenation conditions, in the presence of a third hydrogenation catalyst which comprises a metal component from the group VIIIB class.

4. The method of claim 3 further comprising the steps of:

a. separating hydrogen sulfide and ammonia from said first hydrogenated product before contacting said first hydrogenated product with said hydrogen;

b. separating said hydrogen sulfide and ammonia from said second hydrogenated product before contacting said second hydrogenated product with said hydrogen.

5. A method of producing a food grade white mineral oil from a naphthenic distillate, comprising the steps of:

a. contacting the naphthenic distillate with hydrogen in the presence of a first hydrogenation catalyst under 150–1800 psig and 550–750 degrees Fahrenheit, said first hydrogenation catalyst comprising metal components from the group VIB class and being free of aluminum, silica or borea to prevent unwanted hydrocracking reactions, to form a first hydrogenated product, which first hydrogenated product has a viscosity index increase of less than 20;

b. contacting the first hydrogenated product from step a. with hydrogen, under hydrogenation conditions, in the presence of a second hydrogenation catalyst under 2500–3000 psig and 575–750 degrees Fahrenheit to form a second hydrogenated product, said second hydrogenation catalyst comprising metal components from the group VIIIB class and the group VIB class;

c. contacting the second hydrogenated product from step b. with hydrogen, under hydrogenation conditions, in the presence of a third hydrogenation catalyst under 2000–3000 psig and 375–600 degrees Fahrenheit, said third hydrogenation catalyst comprising a metal component from the group VIIIB class.

6. The method of claim 5 further comprising the steps of:

a. separating hydrogen sulfide and ammonia from said first hydrogenated product before contacting said first hydrogenated product with said hydrogen;

b. separating said hydrogen sulfide and ammonia from said second hydrogenated product before contacting said second hydrogenated product with said hydrogen.

* * * * *